US005344254A

United States Patent [19]

Sartain

[11] Patent Number: 5,344,254

[45] Date of Patent: Sep. 6, 1994

[54] PIVOTING SCREED EDGER

[75] Inventor: Gene Sartain, Hodges, S.C.

[73] Assignee: Blaw-Knox Construction Equipment Corporation, Mattoon, Ill.

[21] Appl. No.: 47,691

[22] Filed: Apr. 14, 1993

[51] Int. Cl.[5] ..... E01C 19/48

[52] U.S. Cl. ..... 404/104; 404/118

[58] Field of Search ..... 404/101, 104, 105, 118, 404/96, 83, 84.05

[56] References Cited

U.S. PATENT DOCUMENTS

| | | | |
|---|---|---|---|
| 1,480,620 | 1/1924 | Latture . | |
| 1,782,992 | 11/1930 | Johnson . | |
| 3,091,999 | 6/1963 | MacDonald | 404/101 |
| 3,216,337 | 11/1965 | MacDonald . | |
| 3,479,755 | 11/1969 | Schropp | 404/101 X |
| 3,636,831 | 1/1972 | Davin et al. . | |
| 3,680,451 | 8/1972 | Birtchet | 404/104 |
| 3,846,035 | 11/1974 | Davin | 404/84.1 |
| 4,818,140 | 4/1989 | Carlson . | |
| 4,861,191 | 8/1989 | Smith et al. . | |

*Primary Examiner*—Thuy M. Bui
*Assistant Examiner*—James A. Lisehora
*Attorney, Agent, or Firm*—Pearne, Gordon, McCoy & Granger

[57] ABSTRACT

A paving apparatus has an edger which is journaled on a screed by a hinge. The edger swings out to allow paving material to fill areas beyond the screed which are not part of the primary surface being paved, such as intersecting driveways. The edger is a vertical plate with a horizontal wear plate along its bottom edge. The angle of the wear plate relative to the bottom edge is adjustable to allow for ditches and ramps which are sloped relative to the surface being paved. Movement of the edger and wear plate can be manual or power driven.

12 Claims, 3 Drawing Sheets

PIVOTING SCREED EDGER

BACKGROUND OF THE INVENTION

1. Field of the Invention

This invention relates generally to the field of paving roadways and specifically to a pivoting edger for a paver.

2. Description of Related Art

In laying asphalt pavement roadways and the like, it is widespread practice to employ so-called floating screed paving machines. These machines include a tractor-like main frame having an engine for propulsion and for material distributing functions. Typically, there is a material receiving hopper at the front of the paver arranged to receive hot asphalt material from a truck as the paving machine advances along the roadbed. Slat conveyors or the like are provided to convey the material from the hopper, at the front of the machine, toward the floating screed, at the back of the machine. Immediately in front of the screed, there is typically provided a distributing auger, which receives the raw asphalt material from the slat conveyor and conveys it laterally so as to distribute the material along the front edge of the screed. As the machine advances along the prepared roadbed, the raw asphalt material flows under the screed, which levels, smoothes and compacts it to provide a continuous, level pavement mat.

Each end of the screed has an edger which is a vertical plate extending forwardly from the screed at a right angle to the screed. A horizontal wear plate extends along the bottom edge of the vertical plate and is vertically adjustable by a pair of hand jacks. The edger keeps paving material from spilling out past the end of the screed and forms a clean edge of the paving material.

In a typical floating screed asphalt paver, the screed is attached to a pair of forwardly extending tow arms which engage the paver frame at their forward extremities. These tow arms are also connected to the paver frame by hydraulic or other actuators arranged to adjust the vertical position of the tow arm extremities in relation to the paver frame. By effecting proper control over the position of the tow arm forward extremities, the screed is maintained in relation to a reference plane or a reference element substantially independent of the irregular vertical motions of the paver frame itself. Thus, it is possible to cause the floating screed to lay a pavement mat which is smooth and level in relation to the underlying base surface.

To control the position of the screed, it has proven advantageous to utilize a mobile reference beam, which is carried along with the paver as it moves over the roadway base surface. Many pavers use a moving reference beam arrangement in connection with the laying of wide pavement mats, utilizing a combination of reference beams, one being towed ahead of the screed and auger, supported on the roadway base grade, and the other being towed behind the screed and auger, supported on the just-laid asphalt mat. The system generally includes leading and trailing reference beams of rigid structure, independently supported by a plurality of yieldable supports. The leading reference beam is supported by a plurality of shoes or plates, while the trailing beam is supported by a pair of shoes.

When paving a road, the paving material is distributed relatively evenly along the base surface. However, when the paver encounters a surface, such as a road or driveway which intersects the road being paved, additional paving material is required to form a smooth transition with the intersecting road or driveway. Typically, the extra material is obtained by slowing the paver, and raising the wear plate to allow material to flow under the edger. The material is distributed with hand rakes to the desired width and depth.

In addition to the paver just described, pavers used to widen an existing road have been described. U.S. Pat. No. 3,636,831 to Davin shows a road widening paver with a blade that swings out from the side of the paver. The blade has an adjustable edger at its end. U.S. Pat. No. 4,861,191 to Smith shows a road widening paver with blades that swing out from opposite sides of the paver. Each blade has an adjustable edger at its end.

It would be advantageous to have a floating screed paver which paves a base surface and also permits paving material to be distributed over a desired width beyond the end of the floating screed at selected locations without adversely affecting paver operation. The device should be adaptable to a floating screed paver capable of paving a full roadway in a known manner. The device should blend the paving material with an intersecting road, whether that road is sloped toward or away from the road being paved. Remote control of the device would be a desirable feature.

SUMMARY OF THE INVENTION

The present invention provides a paving apparatus which includes a movable vehicle capable of distributing paving material and a laterally elongated floating screed disposed on the vehicle for forming a substantially level mat of the paving material. Means are provided to control distribution of paving material beyond an end of the screed.

Preferably, at least one edger is journaled on an end of the floating screed to pivot on a substantially vertical axis. The edger is a vertical plate having a horizontal wear plate along its bottom edge. The wear plate can be adjustable to different angles relative to the bottom edge of the edger. The edger pivots outwardly from the floating screed to permit paving material to flow beyond the end of the screed. When the edger is in an extended position, the wear plate acts as a screed to level the material beyond the end of the floating screed. This reduces the need for hand raking after the paver has passed. The wear plate is adjustable to conform to surfaces adjacent the end of the screed which might slope toward or away from the screed. The edger and wear plate can be moved by hand or by powered drivers, such as a hydraulic piston or electric motor. In this way, paving material can easily be distributed to form a smooth transition between a base surface and intersecting surfaces without adversely affecting the paving of the base surface.

DESCRIPTION OF THE PREFERRED EMBODIMENTS

Figure 1:
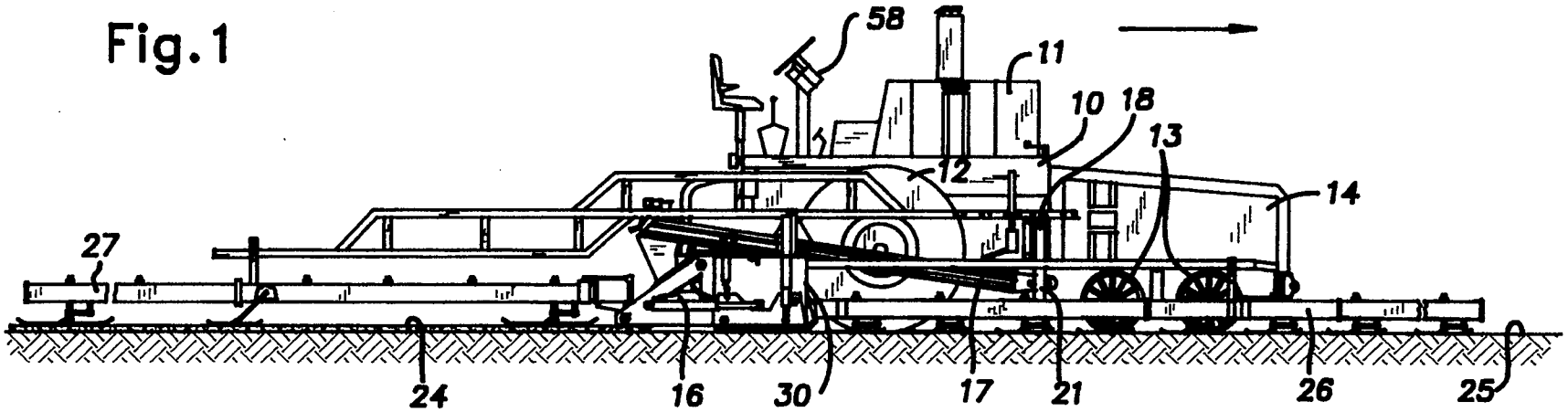
FIG. 1 is a side elevational view of a paving apparatus according to the invention.

Referring to FIG. 1, the reference numeral 10 designates generally a paver frame of a floating screed type asphalt paver. The paver per se is well known in principle and includes an engine or prime mover 11 which provides a source of tractive power and also provides power for various material conveying and distributing functions of the machine. In the illustrated apparatus, a pair of large, pneumatic tires 12 at the back of the paver provide the necessary forward traction, with steerage and support for the front of the paver being provided by pairs of smaller wheels 13.

In front of the paver 10, there is conventionally provided a hopper 14 arranged to receive paving material, which may be aggregate, asphalt, and the like, from the tilted body of a truck (not shown). In accordance with conventional practice, the truck is brought into contact with the front of the paver, and then is pushed along by the paver, continuously discharging its contents into the hopper 14 during the progress of the paving operation, until the complete truckload is exhausted. Thereafter, the empty truck is replaced by a new, fully loaded truck, with the paving operation continuing from the hopper supply during the changeover interval.

Figure 2:
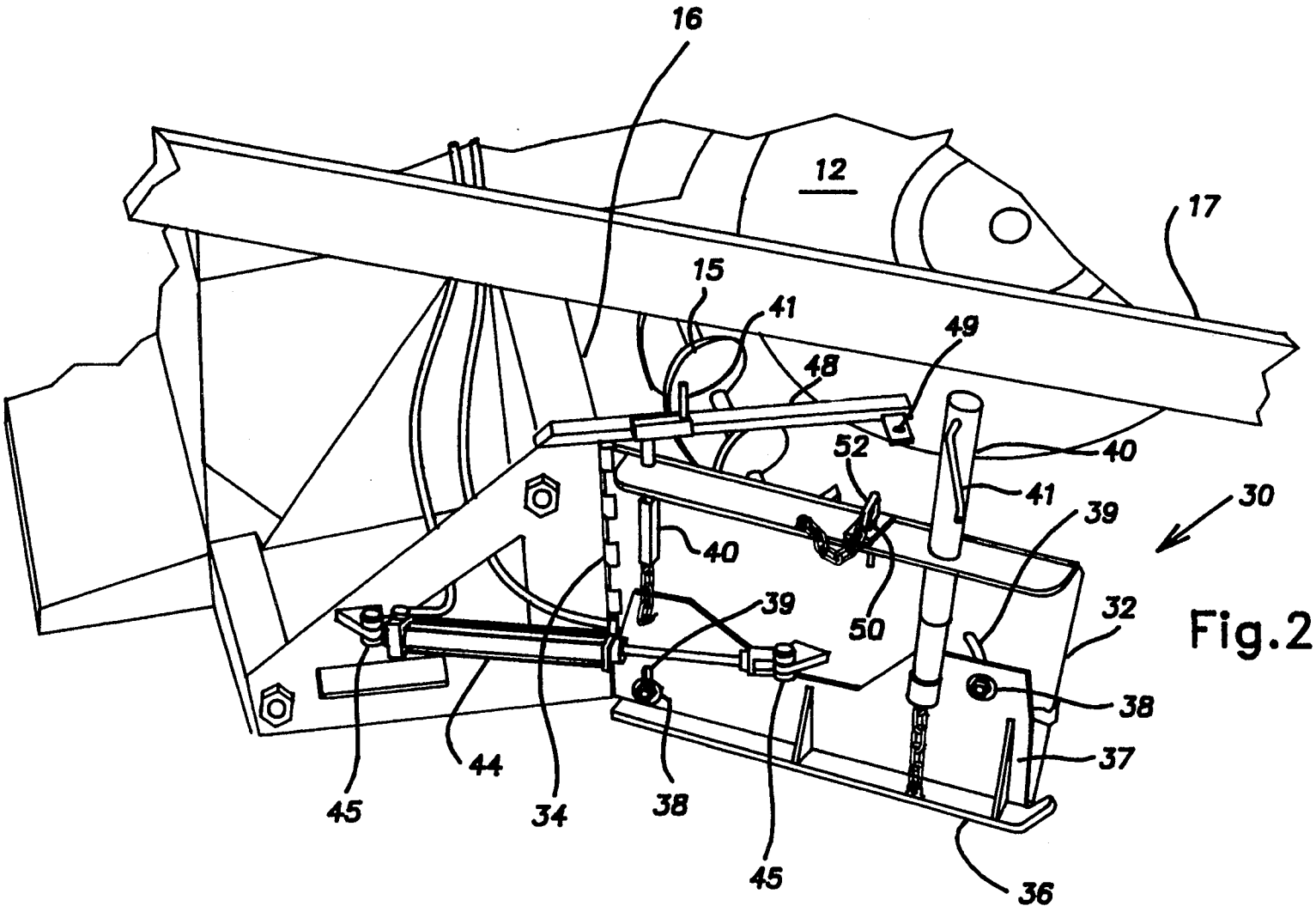
FIG. 2 is a detail view in perspective of an edger according to the invention.

By means of a suitable slat conveyor (not shown) the paving material is conveyed from the hopper 14 to the back of the machine and deposited in front of a means to supply paving material to an area forward of the screed, such as a controllably rotated auger 15 (FIG. 2). The auger is pitched oppositely from the center, so as to convey the conveyor-discharged paving material laterally outward and distribute it more or less evenly along the full length of the auger. In this respect, it will be understood that the basic body of the paver frame 10 may have an overall width of 10 or 12 feet, for example, to accommodate its over-the-road transportation from place to place. At the same time, the paver may be and often is set up in a configuration to lay paving mats in an uninterrupted width of 20 to as much as 40 feet on occasion. In such cases, the overall width of the auger is substantially equal to the full paving width.

Disposed immediately behind the auger is a strike-off and screed structure generally designated by the numeral 16, which is carried by a pair of forwardly extending tow arms 17. The screed assembly 16, like the auger, has a width corresponding to the desired paving width, and thus may be substantially wider than the width of the paver frame 10. The tow arms 17, are spaced so as to be closely adjacent to sides of the paver frame. Accordingly, the tow arms 17 may engage the screed assembly 16 well inboard of its lateral extremities. Intermediate portions of the tow arms extend upwardly and over the top of the area occupied by the auger.

The tow arms 17 may be connected to the paver frame by means of actuator assemblies 18 which are used to adjust the screed height by adjusting the tow arms. The forward extremities of the tow arms may be appropriately raised or lowered in relation to the paver frame itself to effect desired adjustments in the angular attitude of the tow arms 17 and the screed assembly 16. Similar arrangements are, of course, provided at both sides of the machine, with the respective actuators being separately controllable, however, to provide for independent manipulation of tow arm elevation on opposite sides of the machine. The screed may comprise plural sections pivotally joined and adapted to be flexed at the joints to form a relatively convex or concave screed. Thus, the screed can form a crown or gulley of the paving material.

A smooth, level mat 24 of paving material may be laid by the screed assembly 16 more or less independently of variations in the base roadbed 25 and also more or less independently of changes in the suspension of the paver frame 10 itself resulting from changing loads in the hopper 14, for example, or movement of the wheels into or over minor discontinuities or obstructions in the roadway. In accordance with well known principles, this is realized in part by providing a so-called grade reference level, which is independent of the paver frame 10, and by maintaining the tow point of at least one of the arms 17, at a predetermined height in relation to that reference.

A suitable artificial grade reference may be derived from the base roadbed itself, by means of an elongated reference beam individually supported by a large plurality of independently yieldable supporting elements. The base roadbed 25 may be a prepared but unpaved base, or may even be a previously laid asphalt course, where the finished pavement mat consists of more than one asphalt course.

The paving machine is provided with dual mobile reference beams 26 and 27 carried alongside and closely adjacent to the paver frame 10, with one reference beam 26 being carried forward of the auger-screed area and the second reference beam 27 being carried to the rear. The trailing reference beam 27 is supported on the fresh mat 24 behind the screed.

Figure 3:
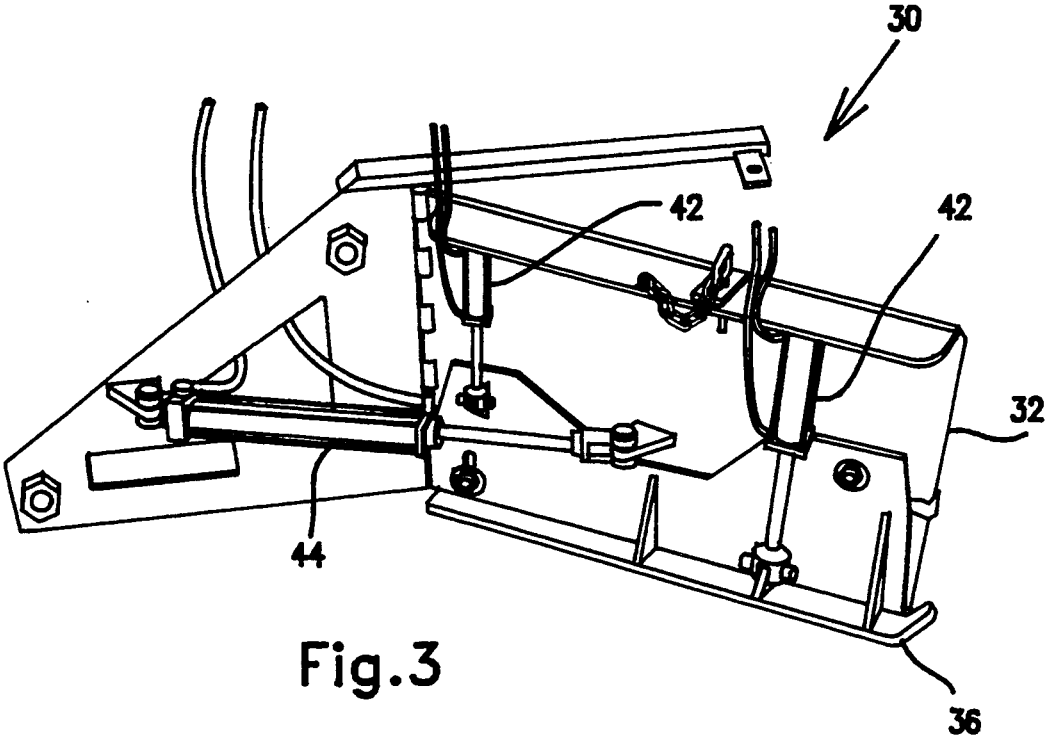
FIG. 3 is a detail view of an alternative embodiment of the edger.
Figure 4:
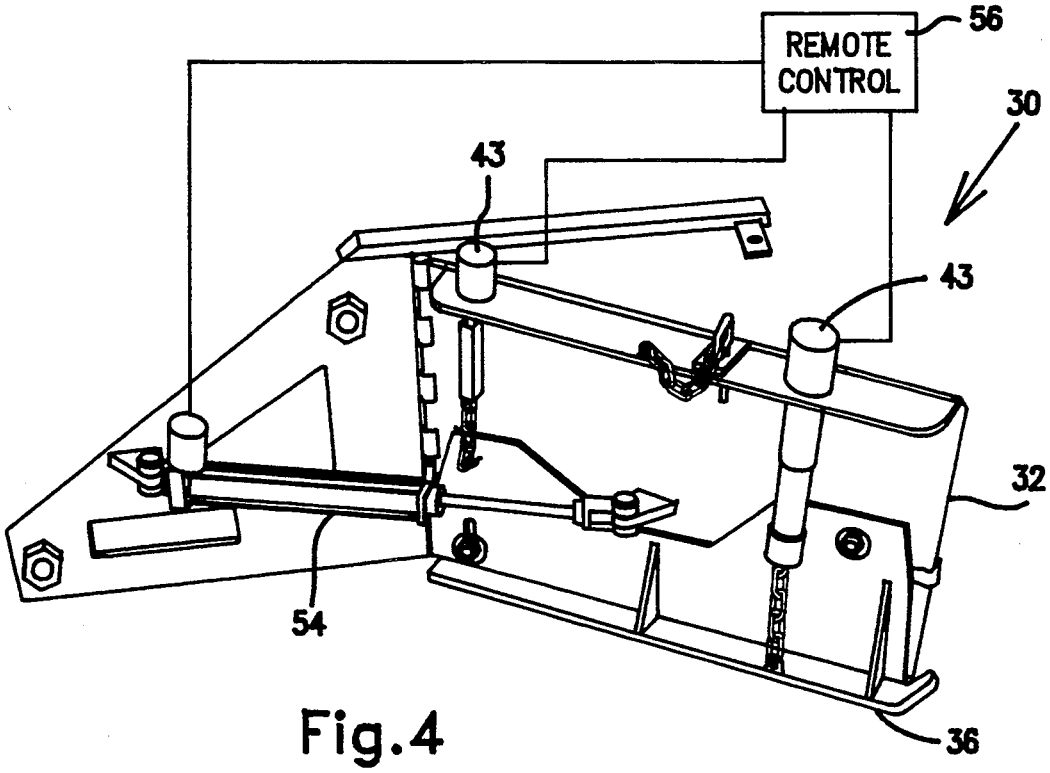
FIG. 4 is a detail view of another embodiment of the edger.

Referring to FIG. 2, means to control distribution of paving material beyond an end of the screed, such as an edger 30, is disposed at each end of the screed 16. The edger 30 includes a vertical plate 32, having a substantially horizontal bottom edge, journaled on an end of the screed by means of a vertical hinge 34. A generally horizontal wear plate 36 is disposed along a bottom edge of the vertical plate 32. The wear plate 36 includes a vertical part 37 parallel with the vertical plate 32 of the edger. Preferably, the wear plate 36 is vertically movable relative to the vertical plate 32 of the edger. For example, the wear plate can be fastened to the vertical plate with bolts 38 extending through slots 39 in the vertical plate and through the vertical part 37 of the wear plate 36. The wear plate can be adjusted to different heights and angles by moving means such as jacks 40. The jacks are disposed between the wear plate 36 and the vertical plate 32 to achieve relative adjustment between the plates by cranking handles 41 on the jacks 40. As shown in FIGS. 3 and 4, the jacks can be replaced by other moving means such as hydraulically operated piston-type jacks 42 or electric motors 43. When jacks 42 or motors 43 are used, the bolts 38 are not tightened completely.

The edger 30 is pivotally adjustable on the hinge 34 relative to the screed 16. A means to move the edger 30, such as a hydraulic piston-type jack 44, is attached between the screed 16 and the edger 30 with pivots 45 at each end. The screed is adjustable from a 90° angle forward of the screed to a position where it is substantially co-planar with a front face of the screed.

A forward extension 48 of the screed 16 is provided with a hole 49. A corresponding hole 50 is provided in the edger. A safety pin 52 is provided to be inserted through the holes 49, 50 to fix the edger in a position normal to the screed. The pin 52 locks the edger in place during transport of the paver from one location to another.

As shown in FIG. 4, the edger moving means can be an electric motor disposed between the edger 30 and the screed 16. In addition, a means 56 to remotely control the edger adjusting means 54 and the wear plate moving means 43 from an operator's station 58, shown in FIG. 1, can be provided.

In operation, the paver 10 moves over the base surface of the roadbed 25 in the direction of the arrow. Paving material from the hopper 14 is distributed in front of the screed 16 by the auger. The edger 30 is positioned normal to the screed 16 to prevent paving material from flowing past the end of the screed. The screed levels the paving material to form a smooth mat while the height and attitude of the screed are controlled as discussed above. The paver travels forwardly at a relatively constant rate leaving a smooth, level pavement mat behind the screed.

During the paving operation, it will be desirable at certain locations to distribute paving material beyond the end of the screed. For example, at driveways 60, shown in FIGS. 5 and 6, which intersect the roadway being paved, extra paving material is required to form a smooth transition between the fresh mat and the intersecting driveway. To obtain the extra paving material, the edger is pivoted outwardly by means of the piston 44 or motor 54. The edger is positioned at an angle relative to the screed so as to allow paving material to flow beyond the end of the screed. The wear plate 36 levels the paving material so that the edger acts as a screed. The angle of the edger is selected to control the distance which the paving material flows beyond the end of the screed 16. The further the edger is pivoted outwardly, the further the paving material will flow beyond the end of the screed.

Figure 6:
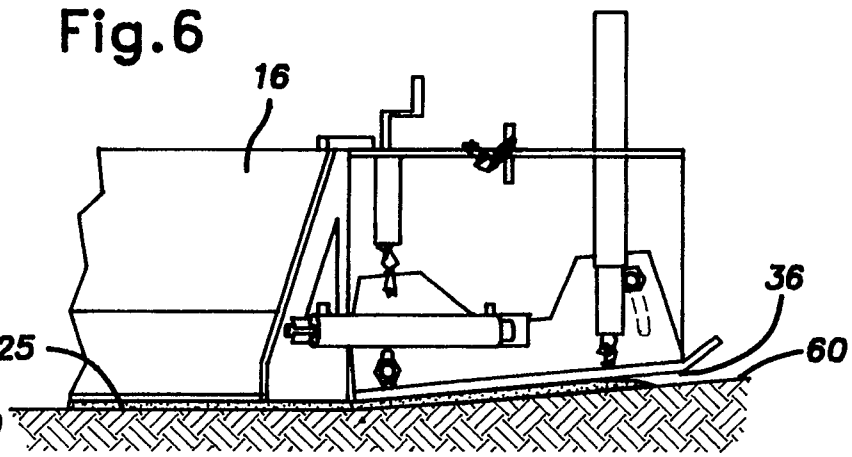
FIG. 6 is a rear elevational view of the edger adjusted for an upward slope.
Figure 5:
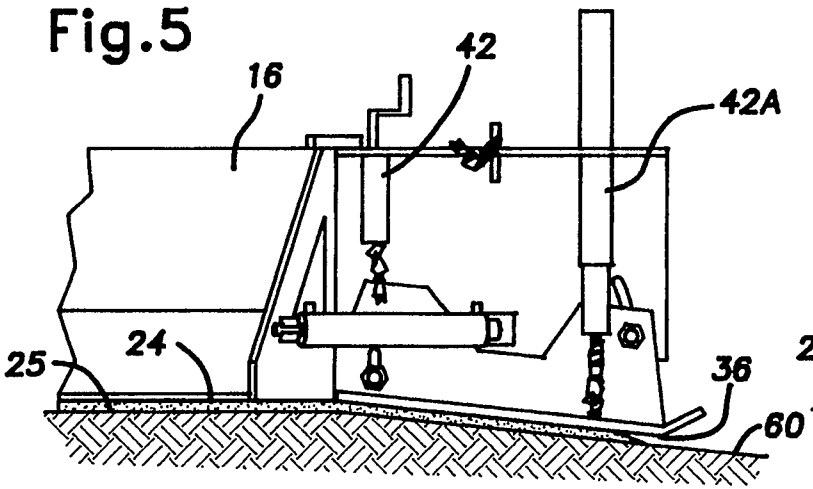
FIG. 5 is a rear elevational view of the edger adjusted for a downward slope.

As previously discussed, the wear plate 36 is adjustable relative to the vertical plate 32. The height of the wear plate can be adjusted to control the height of the mat laid beyond the end of the screed 16. Wear plate height is adjusted with the hand jacks 40, hydraulic jacks 42, or motors 43. Where the intersecting driveway 60 slopes downwardly away from the roadbed 25, as shown in FIG. 5, the outer end of the wear plate is lowered to conform to the slope. Similarly, as shown in FIG. 6, where the intersecting driveway 60 slopes upwardly away from the roadbed, the outer end of the wear plate 36 is raised to conform to the slope. Preferably, the outer piston **42*a*** is used to adjust the wear plate angle.

After the paver 10 passes the driveway 60, the edger 30 is pivoted to its original position normal to the screed 16, and the wear plate 36 is returned to a generally horizontal position. Again, the edger prevents paving material from spilling past the end of the screed to form an edge of the fresh mat 24.

For efficient operation, the edger angle and wear plate angle can be controlled from the operator's station 58. Thus, the need for a worker to be stationed at the end of the screed to operate the edger is eliminated.

The extra paving material has been levelled by the edger 30, but, after the paver has passed, some raking may be required to blend the paving material with the driveway at the edge. The extra paving material should also be rolled, as should the fresh mat 24.

The present disclosure describes several embodiments of the invention, however, the invention is not limited to these embodiments. Other variations are contemplated to be within the spirit and scope of the invention and appended claims.

What is claimed is:

1. A paving apparatus, comprising:

a movable vehicle capable of distributing paving material;

a laterally elongated screed disposed on the vehicle for forming a substantially level mat of the paving material;

a continuously movable edger comprising a substantially vertical plate having a bottom edge and journaled on an end of the floating screed to pivot on a substantially vertical axis;

remotely controlled powered means to move and secure the edger at a selected horizontal angle relative to the screed to control distribution of paving material beyond an end of the screed during a paving operation;

a generally horizontal wear plate pivotably mounted to extend along the bottom edge of the vertical plate for levelling the paving material;

means to move and secure the wear plate at a selected vertical angle relative to the bottom edge.

2. A paving apparatus according to claim 1, further comprising an auger to distribute paving material to an area forward of the screed toward an end of the screed.

3. A paving apparatus according to claim 1, wherein the screed is vertically adjustable.

4. A paving apparatus according to claim 1, wherein the wear plate moving means comprises two independently operable jacks connected between the wear plate and the vertical plate and located near opposite ends of the edger.

5. A paving apparatus according to claim 1, wherein the wear plate moving means comprises a hydraulically actuated jack connected between the wear plate and the vertical plate.

6. A paving apparatus according to claim 1, wherein the wear plate moving means comprises an electric motor.

7. A paving apparatus according to claim 1, further comprising means to remotely control the wear plate moving means.

8. A paving apparatus according to claim 1, wherein the angle relative to the screed is obtuse.

9. A paving apparatus according to claim 1, wherein the edger moving means is a jack including a hydraulically actuated piston attached between the edger and the screed.

10. A paving apparatus according to claim 1, further comprising a pin means to secure the edger in a position substantially normal to the screed.

11. A paving apparatus according to claim 1, further comprising at least one elongated reference beam towed by the vehicle and serving as a reference for the floating screed.

12. A paving apparatus according to claim 1, wherein the screed is adapted to float on the paving material.

* * * * *